US006070991A

United States Patent [19]

Rumpel

[11] Patent Number: 6,070,991

[45] Date of Patent: Jun. 6, 2000

[54] DECORATIVE LIGHT FIXTURE

[76] Inventor: Donald Rumpel, HC-1 Box 216, Kellogg, Id. 83837

[21] Appl. No.: 09/193,799

[22] Filed: Nov. 17, 1998

[51] Int. Cl.[7] ..... F21V 21/116

[52] U.S. Cl. ..... 362/249; 362/252; 362/806

[58] Field of Search ..... 362/249, 250, 362/252, 288, 367, 382, 388, 396, 418, 806, 807, 808

[56] References Cited

U.S. PATENT DOCUMENTS

| | | | |
|---|---|---|---|
| 4,783,726 | 11/1988 | Wang | 362/252 |
| 5,629,057 | 5/1997 | Wang et al. | 362/806 |
| 5,645,343 | 7/1997 | Rinehimer | 362/249 |
| 5,772,312 | 6/1998 | Pihl-Niederman et al. | 362/249 |

*Primary Examiner*—Y. Quach

*Attorney, Agent, or Firm*—Wells, St. John, Roberts, Gregory & Matkin, P.S.

[57] ABSTRACT

A decorative light fixture is described in which a pair of frames are provided, each with a central hub section and with arms spaced angularly about the hub and formed in a semi-spherical configuration about a central point. A band releasably joins the pair of frames with their central points substantially coincidental along an axis in such a manner that the arms of both frames form a substantially spherical configuration. Socket mounts are provided on the arms at varying positions spaced substantially radially from the central points. The arms of each frame are bendable from substantially flat orientations in which the arms extend radially from the associated central hub, with the socket mounts spaced radially therefrom to releasably receive and mount lenses or, alternatively, conventional Christmas light sockets.

16 Claims, 11 Drawing Sheets

DECORATIVE LIGHT FIXTURE

TECHNICAL FIELD

The present invention relates to decorative support for lights and more particularly to decorative fixtures that are capable of mounting and supporting Christmas light strand sockets.

BACKGROUND OF THE INVENTION

Various devices have been developed to support conventional Christmas light strands in decorative manners. Christmas lights traditionally have been used to decorate Christmas trees. However other decorative uses for Christmas light strands have been found. Among such other uses, clips have been developed to enable Christmas light strands to be attached to structures such as the eaves of houses. In other uses, the strands are formed over wire or other structures formed in shapes, for example various animals, for use as lawn or window decoration.

Most uses for Christmas light strands involve extending the strand over a defined distance where the individual lights appear independently and not as a tight cluster. However tightly spaced lights have been found to provide special decorative effects. Light fixtures have not heretofore been commonly available to hold a cluster of such "strand" type Christmas lights in closely spaced or random patterns for decorative effect. A need for such a fixture has been recognized.

Light fixtures with fixed light sockets such as chandeliers are bulky, expensive, and are not often used for decorative holiday effect. Light fixtures that make use of Christmas type light strands have a defined shape and use, such as lighted stars for Christmas tree tops. These type fixtures, while serving well for their intended purpose, do not fill the need for a fixture in which a full strand or more decorative lights may be used in a random cluster for decorative effect.

An objective of the present invention is to provide a decorative light fixture that may be used to mount one or more strands of conventional Christmas lights in a closely spaced array for decorative purposes.

Another objective is to provide such a fixture that is versatile in that portions of the fixture may be selectively used to mount either Christmas light strand sockets or decorative lenses for decorative visual effect.

A still further objective is to provide such a fixture that may be suspended for decorative effect.

A yet further object is to provide such a fixture that is substantially transparent to enable transmission of light from within the fixture and provide a decorative external surface for diffusion and reflection of such light.

These and still further objects and advantages will become apparent upon reading the following detailed description and viewing the appended drawings.

BRIEF DESCRIPTION OF THE DRAWINGS

Preferred embodiments of the invention are described below with reference to the following accompanying drawings.

FIG. 17 is a side elevational view illustrating the manner in which arms of a frame are bent about a center point to join a ring, and form part of the spherical configuration.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

A decorative light fixture including features of preferred forms of the present invention is generally indicated at 10 in the accompanying drawings. The fixture 10 may be produced in any of several decorative modes preferably using one or more conventional Christmas light strands 12, a portion of which is exemplified in FIG. 10. The strand part shown is a conventional "mini" light form of light strand that is commercially available and produced by numerous Christmas light manufacturers. It should be noted, however, that the preferred strand may or may not be supplied with a light strand.

Figure 10:
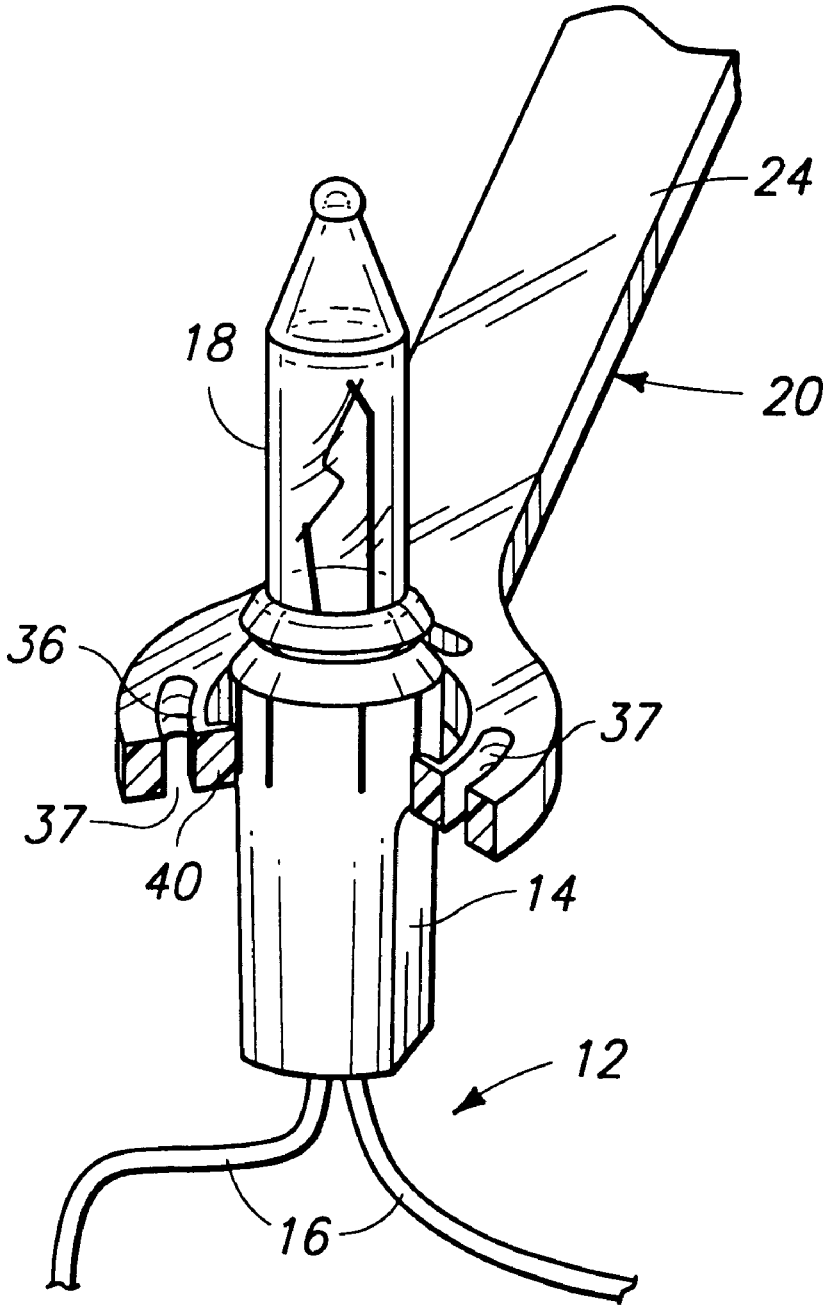
FIG. 10 is a fragmented perspective view showing a Christmas light from a Christmas light strand mounted to a socket in a frame.

It is useful for purposes of further description to note that the typical conventional light strand (a part of which is shown in FIG. 10) includes a light socket 14 that may be connected by appropriate electrical wires 16 to a source of electrical energy. A bulb 18 is typically releasably mounted within the socket 14.

Figure 1:
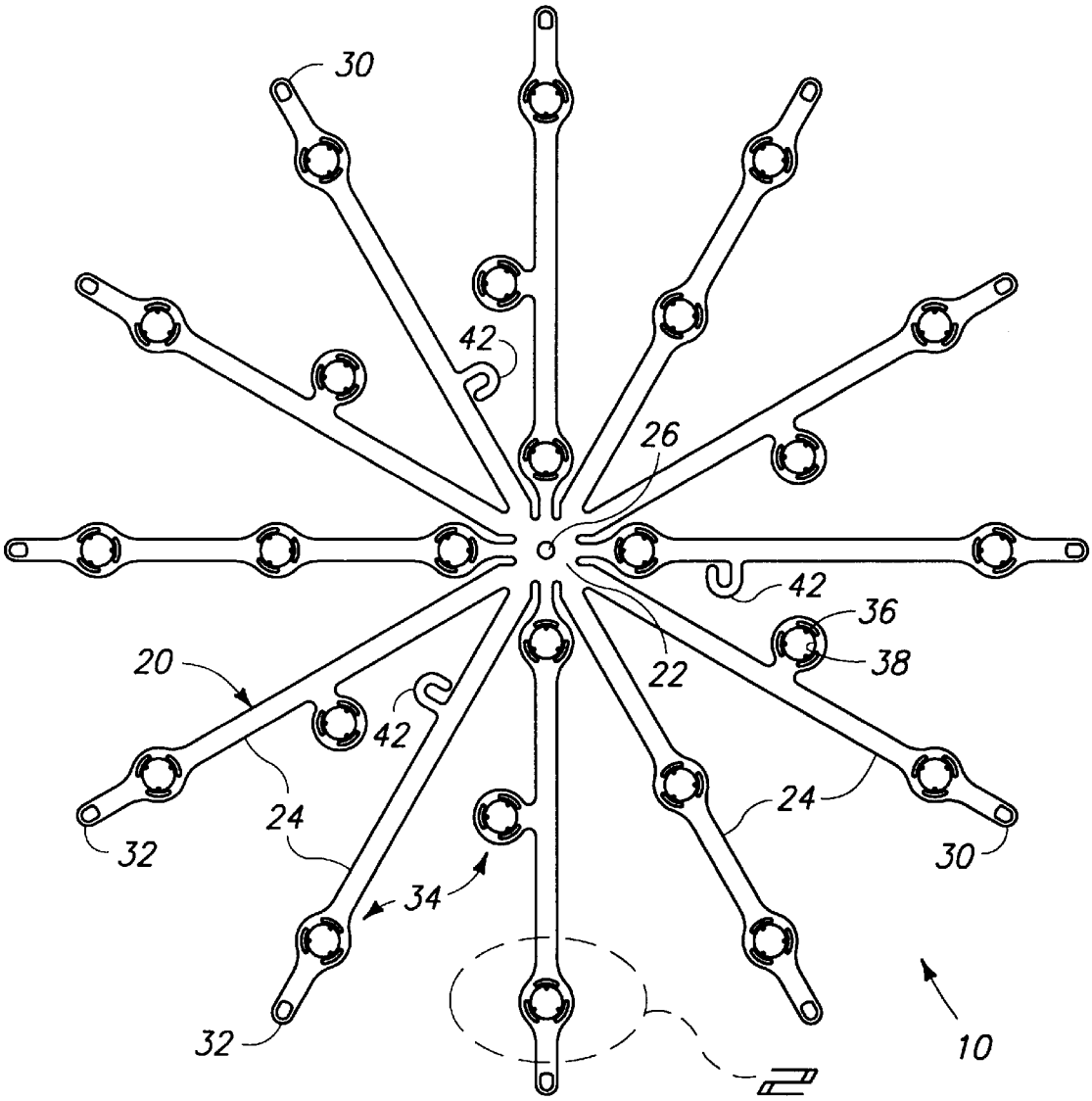
FIG. 1 is a flat plan view of a single frame with arms extending substantially radially therefrom.
Figure 11:
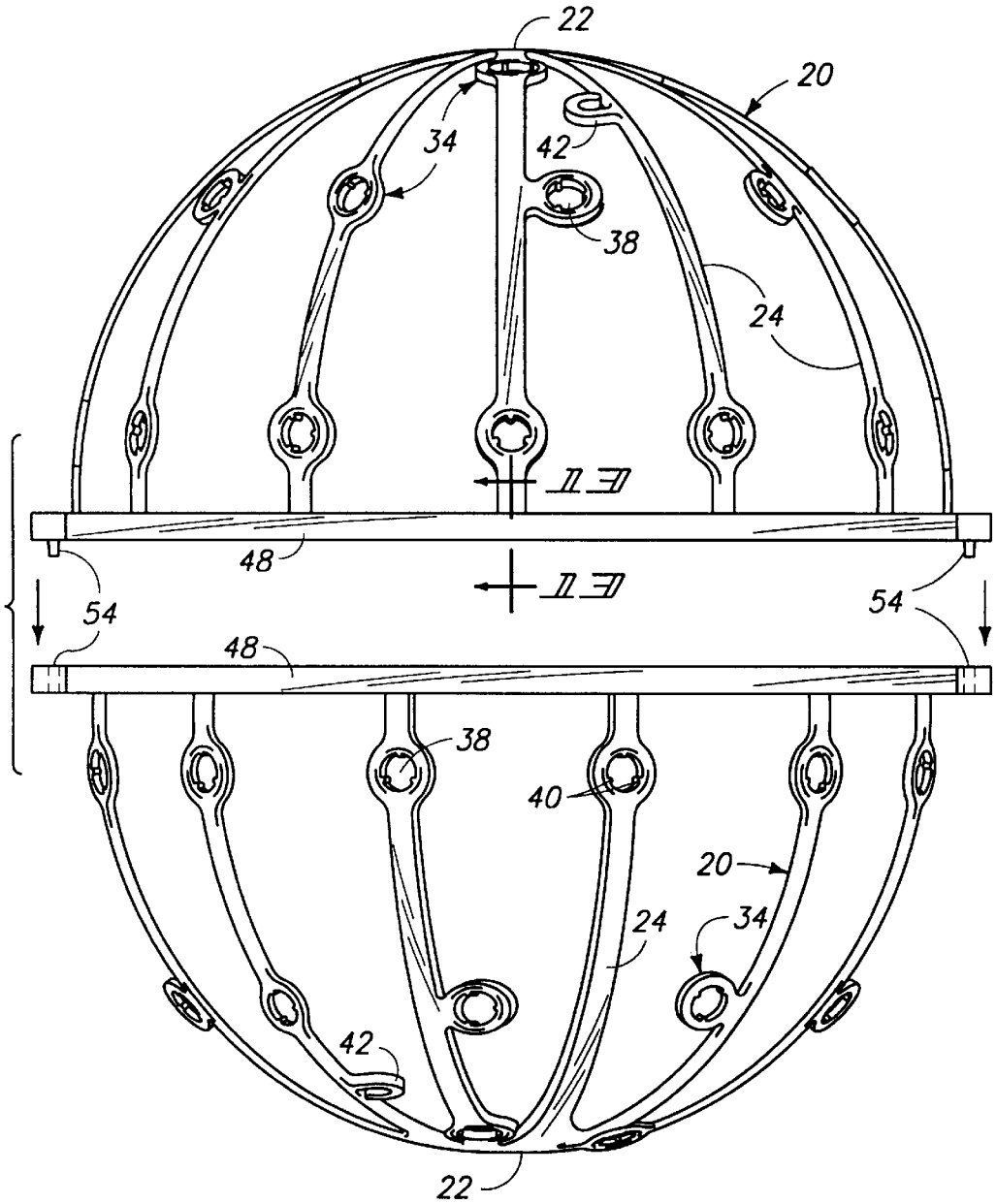
FIG. 11 is a view of two frames with arms bent and mounted to rings, ready for assembly to form a spherical configuration.
Figure 12:
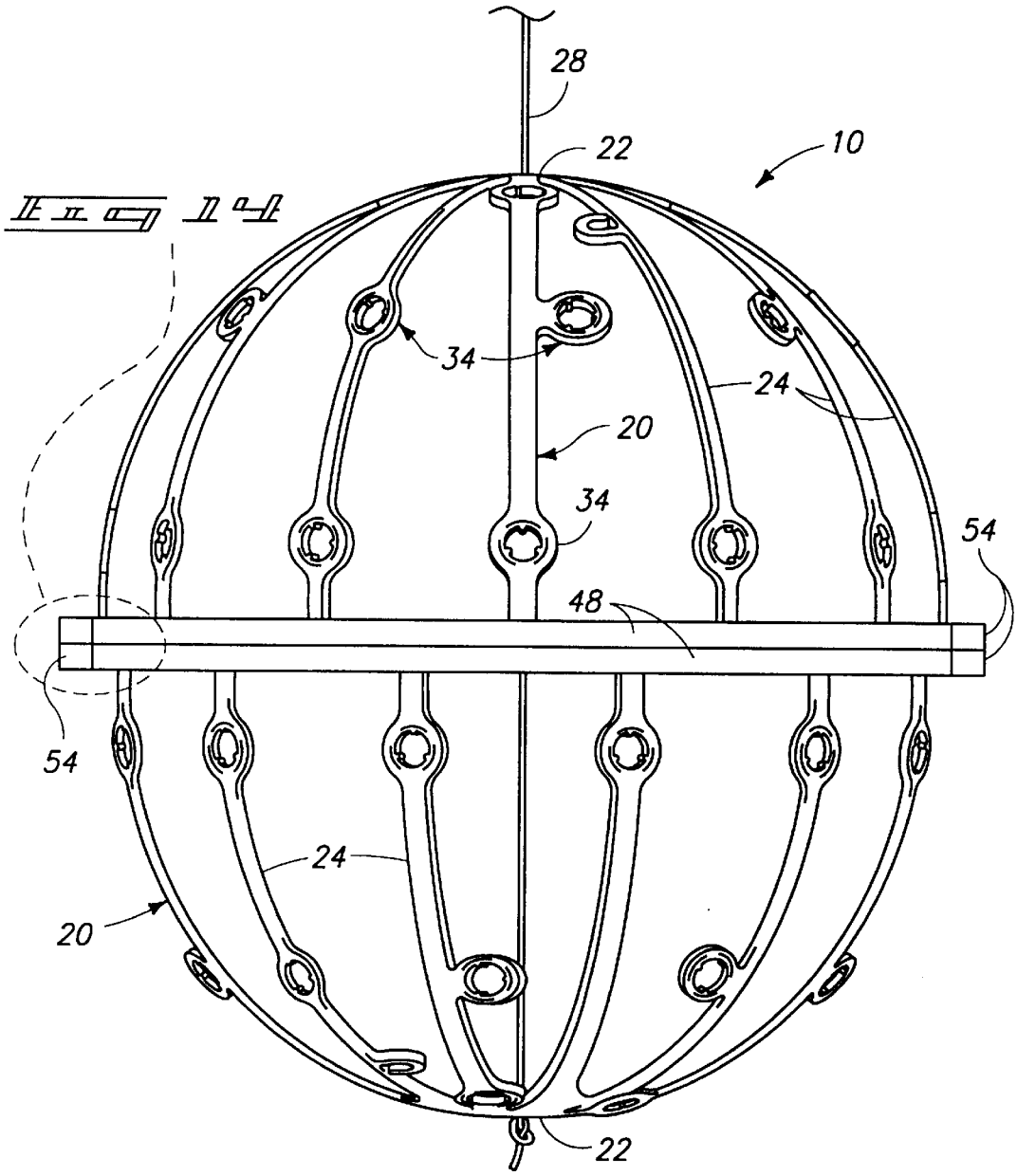
FIG. 12 is a view similar to FIG. 11 only showing the two frames assembled and with a suspension cord attached.

Referring in greater detail to the present fixture 10, a preferred frame 20 is shown in FIG. 1 and in pairs in FIGS. 11 and 12. In general, each frame 20 includes a central hub section 22. It is preferred that substantially radially extending arms 24 be spaced angularly about the hub 22.

The number of arms 24 may be varied from that shown. Further, the angular orientation of the arms with respect to the hubs, though preferably substantially radial (in the flat pattern shown in FIG. 1) may vary. For example, it may be desirable that the arms be formed in a spiral configuration (not shown) or another configuration not shown but included within the scope of this invention. It is presently preferred, however, that the arms 24 be substantially radially oriented with respect to the central hubs 22.

It is preferred that a cord receiving aperture 26 be formed through each of the central hubs. The cord apertures 26 are configured to receive a cord 28 (FIG. 12) for hanging the decorative light fixture 10.

It is also preferred that the frames 20 (including the arms 24) be formed of flexible material enabling the arms to be bent about a center point P (FIG. 17) that will eventually become the center point of the spherical configuration for the fixture. The center point P is spaced on an axis A from the center hubs 22. The axis preferably passes through the cord apertures 26.

In preferred forms the frames 20 are formed by injection molding a plastic material such as a styrene compounded with butyrate for flexibility. It is most preferred that the frame be formed of such material that is substantially transparent. Appropriate coloring may also be present in the material without substantially affecting light transmission or visual access.

The frame arms extend outwardly to arm ends 30 which are preferably equally spaced in a radial direction from the hubs 22. Thus, as shown in the flat pattern in FIG. 1, the arm ends 30 are substantially situated in a circle centered on the hub 22, and more particularly, on the cord aperture 26. The preferred arm ends 30 are supplied with mounting apertures 32 which will be described in greater detail below.

Socket mounts 34 are advantageously positioned along the arms, and are most preferably formed integrally with the arms at varying positions spaced substantially radially from the central hubs 22. The socket mounts 34 are preferably of a unique configuration in that they may be used to selectively mount lenses 60 (to be described in greater detail below) or to mount conventional Christmas light sockets 14 (see FIG. 10).

Figure 16:
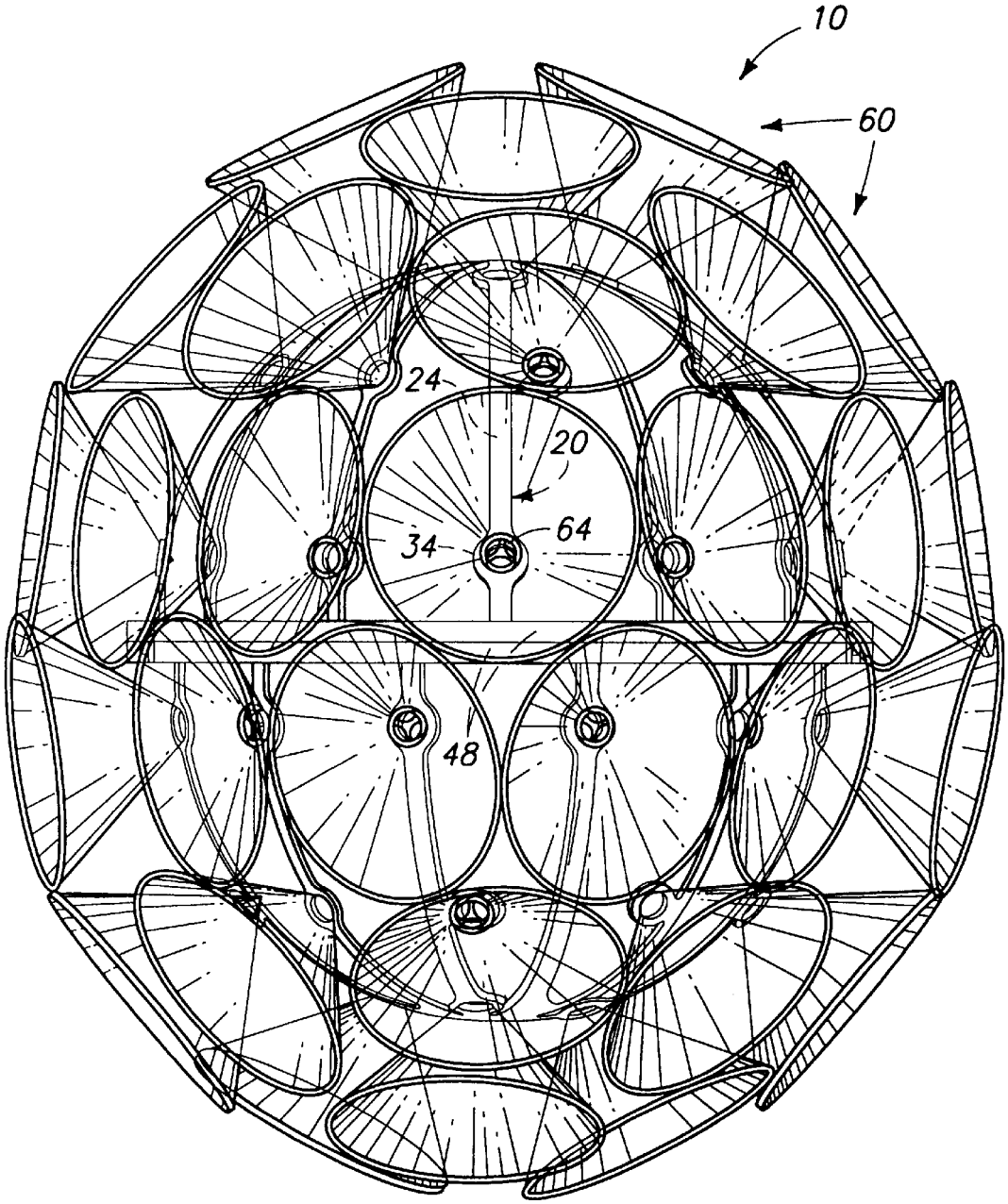
FIG. 16 is a side elevational view of the decorative light fixture with lenses mounted to the assembled frames in a substantially spherical configuration.
Figure 11:
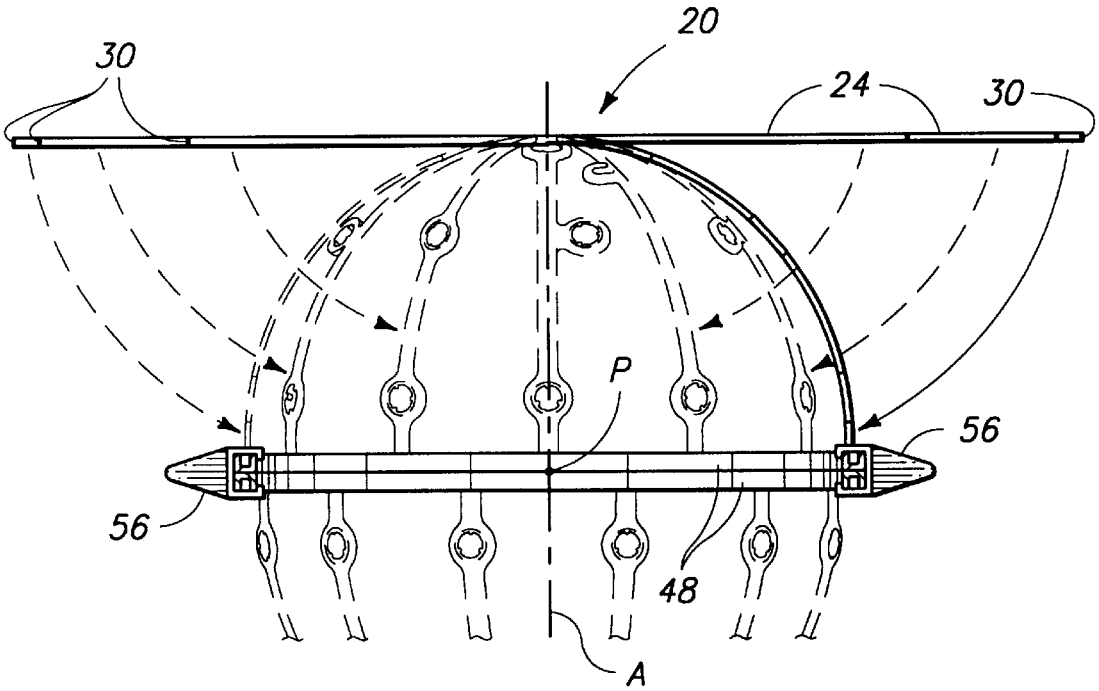

It is preferred that the spacing and orientation of the various socket mounts be as shown in FIG. 1 such that lenses 60, when secured to the mounts will touch tangentially when the arms are bent into substantially spherical configurations as shown by FIG. 16 of the drawings. To this end, some of the socket mounts 34 are centered on the arms, others are offset to sides of the arms.

Figure 2:
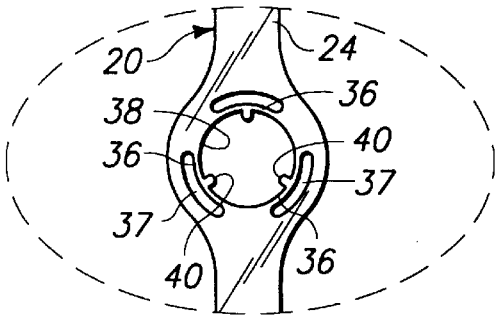
FIG. 2 is an enlarged detail view of the area identified at 2 in FIG. 1.
Figure 3:
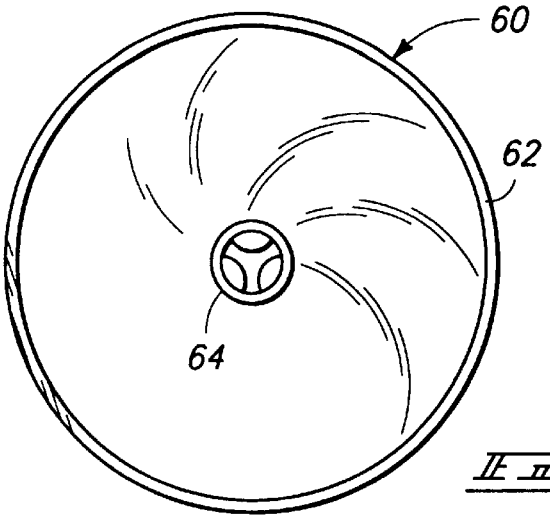
FIG. 3 is a top plan view of a lens for the present fixture.
Figure 4:
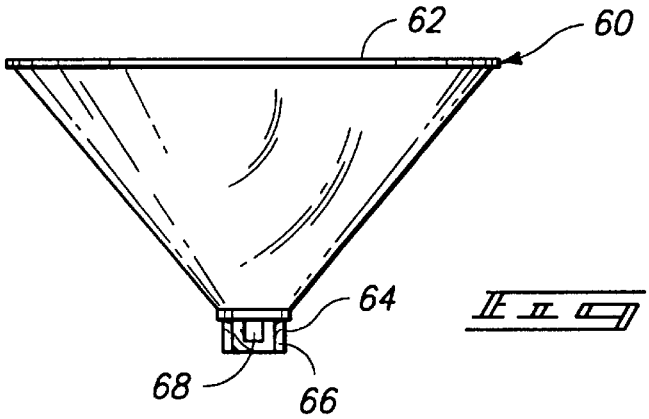
FIG. 4 is a side elevation view of the lens.
Figure 5:
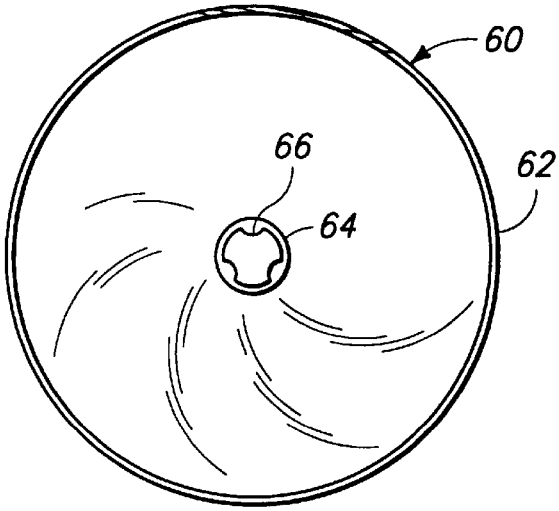
FIG. 5 is a bottom plan view of the lens.

Referring to FIGS. 2 and 10, the socket mounts 34 are shown in detail. Preferred socket mounts 34 include resilient arcuate ribs 36 formed between arcuate slots 37 formed through the frame, and the circumference of the socket receiving bores 38. The plastic material between the bores and the slots is resiliently yieldable to permit insertion of the light sockets as shown in FIG. 10, or to enable secure mounting of the lenses 60.

The internal surfaces of the socket mounts 34 are provided with radially inwardly projecting tabs 40 that also provide a dual function of engaging and holding the light sockets 14 or receiving and locking the lenses 60. The tabs 40 are positioned opposite to the slots 37 along the flexible, resilient ribs 36, and are thereby capable of being forced radially outward against yieldable resistance of the ribs 36. The yieldable socket members are thus shaped to receive and mount conventional Christmas light sockets or, alternatively, the lenses 60.

In preferred forms, at least one and preferably several wire retention hooks 42 are formed integrally with the frames 20. The hooks are preferably located on at least one of the arms 24 and project laterally therefrom. Each hook 42 is configured to receive and secure a Christmas light strand wire W in order to suspend a mass of lights in a random array within the fixture 10 when assembled in a spherical configuration shown in FIG. 16.

It is pointed out that the frames 20 may be used in the flat configuration shown in FIG. 1 as decorations if desired. The star shaped configuration of the flat frames with the socket mounts 34 may be supplied with lights (one of which being shown in FIG. 10) from a conventional light strand for decorative effect. However, the frames are primarily intended to be formed into semi-spherical configurations for assembly as a spherical decoration shown in FIG. 12 and for final assembly with lenses 60 as shown in FIG. 16.

Figure 13:
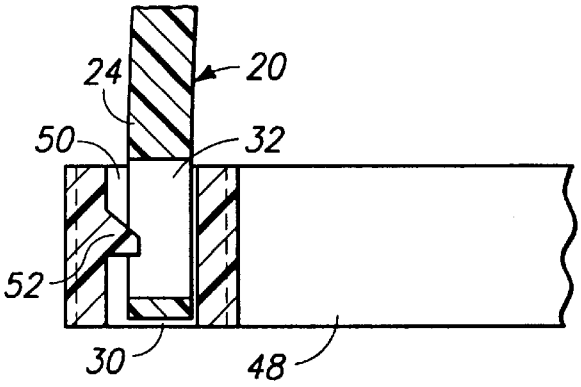
FIG. 13 is an enlarged detail view taken substantially along line 13—13 in FIG. 11.

As indicated above, the arm ends 30 in preferred forms are provided with latch openings 32 that may be used for securing the arms to circular bands 48, one of which is provided for each frame 20. Arm end receiving sockets 50 (FIG. 13) are formed within the circular bands 48 to receive and substantially lock the arm ends in place. Locking tabs 52 are provided within the arm end receiving sockets 50 to snap into the openings 32 and secure the arms ends in bent, semi-spherical configurations about the center points P (FIG. 17) which are substantially coincidental with the centers of the circular bands 48.

The bands 48 are preferably comprised of circular members formed of the same material as the frames 20. The circular members are preferably "U" shaped in cross section, with the axially open sockets 50 spaced about their perimeters to releasably receive and secure the arm ends 30. The diameters of the bands are such that the arms must be bent in order to insert the arm ends into the sockets 50.

The length of each arm 24 (from the respective hubs 22) may be bent to represent a chord of the final semi-spherical configuration. Each arm length (from hub 22 to arm end 30) is thus made to equal approximately ¼ of the spherical circumference (see the one bent arm in FIG. 17). The diameter of the bands 48 are thus equal to the desired sphere diameter, and when the frames 20 are assembled with the bands 48, each frame and band sub-assembly will form half of the spherical configuration (see FIG. 11).

Figure 14:
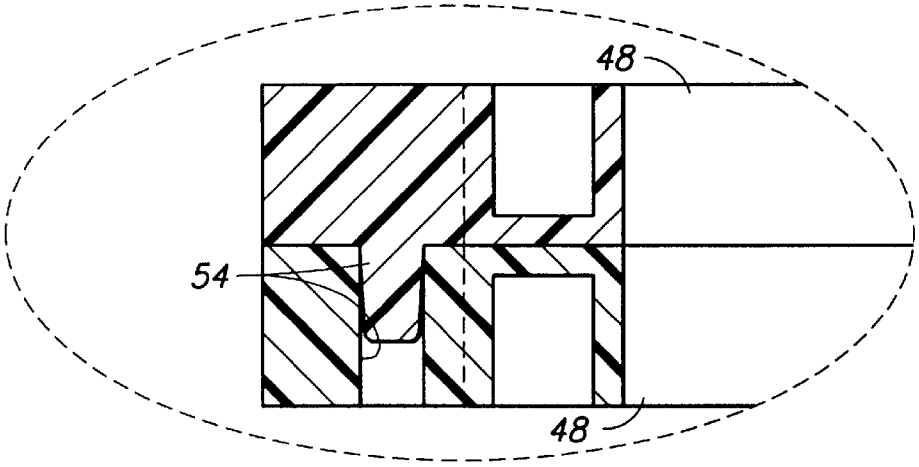
FIG. 14 is an enlarged detail view taken of the area identified at 14 in FIG. 12.
Figure 15:
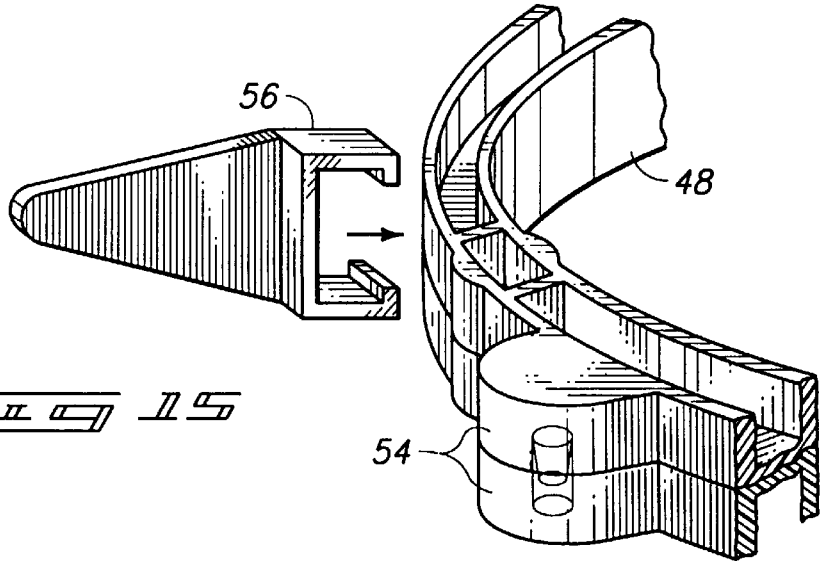
FIG. 15 is an enlarged detail perspective view showing a clasp ready to secure two rings together.

The bent frames 20 and attached bands 48 may be secured with the bands in back-to-back relation as shown in FIGS. 12 and 14 to complete the spherical configuration. Pin and socket arrangements 54 (FIG. 14) are provided on the bands to interlock with the bands in the assembled configuration, thus forming a single ring and forming the bent frames into a spherical configuration. Clasps 56 (FIGS. 15 and 17) are provided in preferred forms for releasably securing the bands together in the back-to-back relation, completing the spherical form.

The lenses 60 will now be discussed in greater detail. A plurality of lenses 60 may be provided of substantially identical form, and be injection molded from the same material as the frames 20 and bands 48. The preferred lenses are shown in detail in FIGS. 3–9 and in an assembled condition with the frames 20 in FIG. 16.

Each preferred lens 60 is conical in shape and is most preferably transparent (with coloration if desired). The conical configuration includes an enlarged open outward end 62 leading to a reduced end forming a male fastener member 64. The diameters of the conical configuration are provided such that a plurality of lenses mounted to the frames will touch tangentially along their outward ends 62. The male fastener members 64 are configured to be mounted to the female socket mounts 34.

FIGS. 6–9 show the male fastener members 64 in detail and the manner by which the lenses 60 may be mounted to the arms 20. The preferred male fastener members 64 are substantially cylindrical (of a diameter just slightly smaller than the bores 38 of the socket mounts 34. The cylindrical shape of each male fastener member 64 is interrupted by equi-angularly spaced indentations 66 that are configured to slidably receive the tabs 40 of the female socket mounts 34. Lateral tab receiving openings 68 are provided about the male fastener members between the indentations 66 to receive the tabs 40 in locking engagement.

Figure 6:
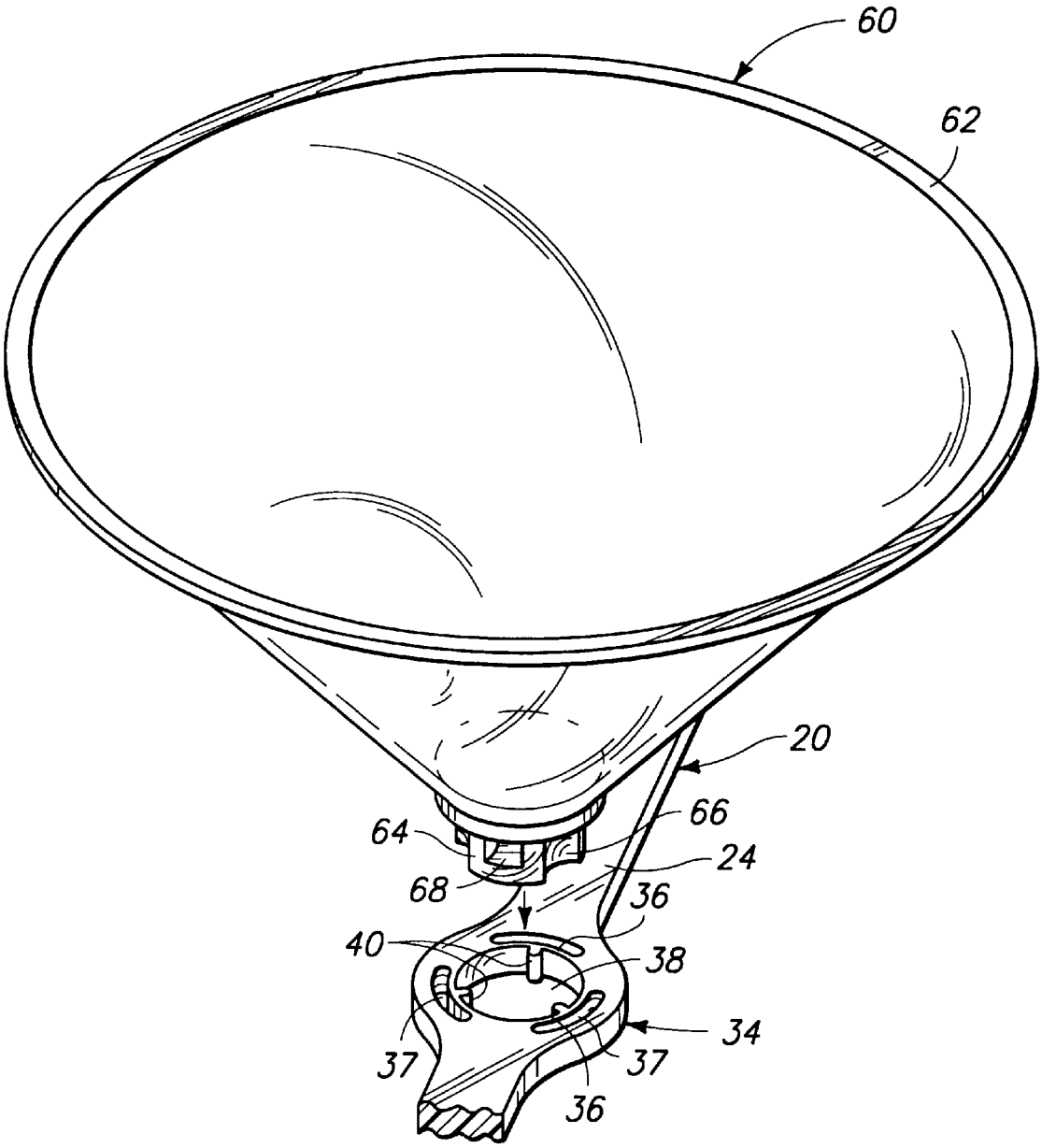
FIG. 6 is an enlarged fragmented view showing a lens in alignment with a socket member and ready for mounting.
Figure 7:
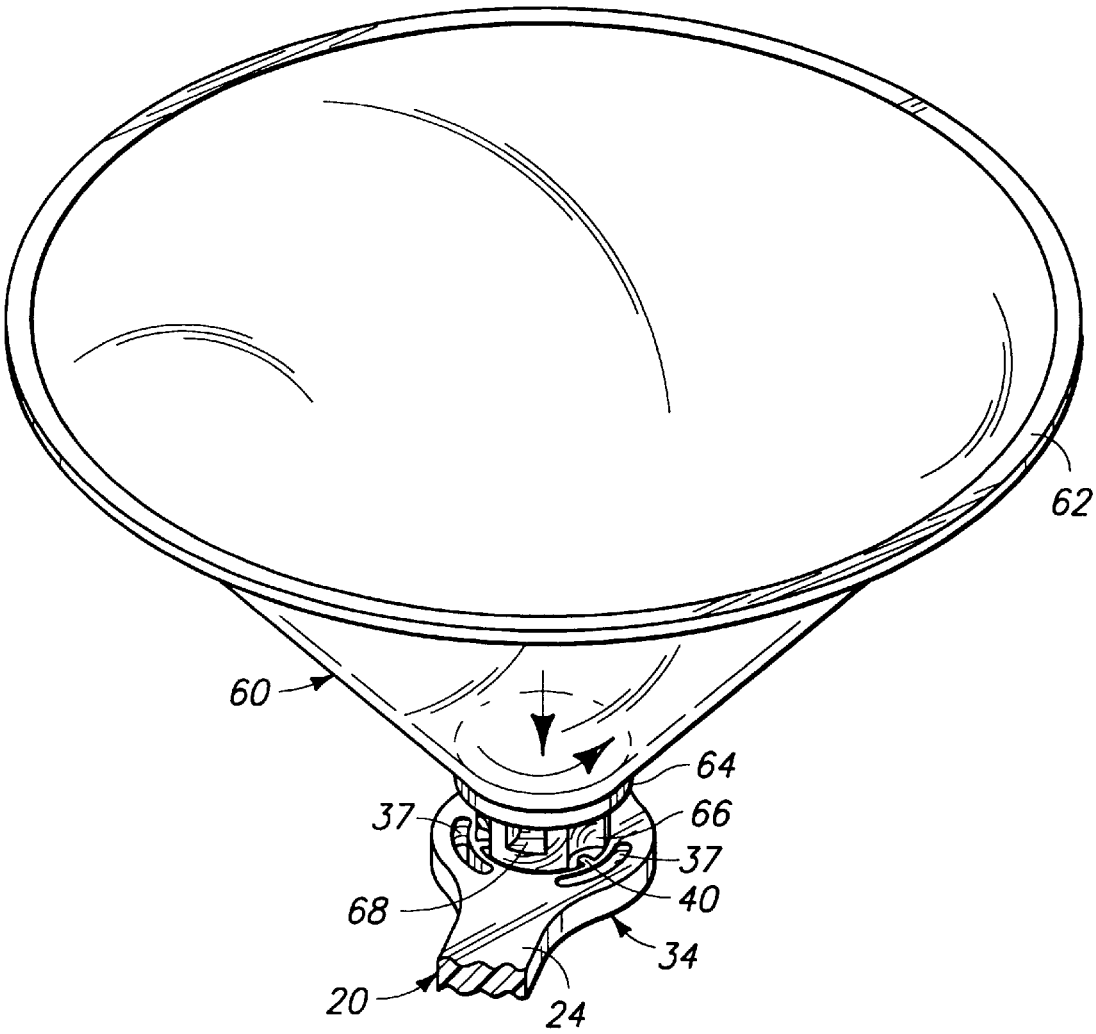
FIG. 7 is a view similar to FIG. 6 only showing the lens partially inserted into the socket member.
Figure 8:
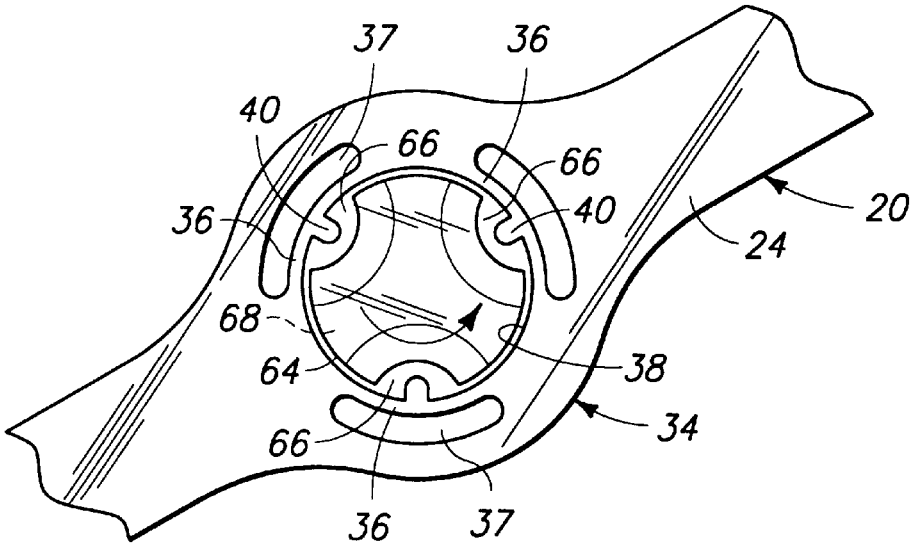
FIG. 8 is a bottom plan detail view showing a lens and socket member positioned for attachment or removal of the lens from the socket member.
Figure 9:
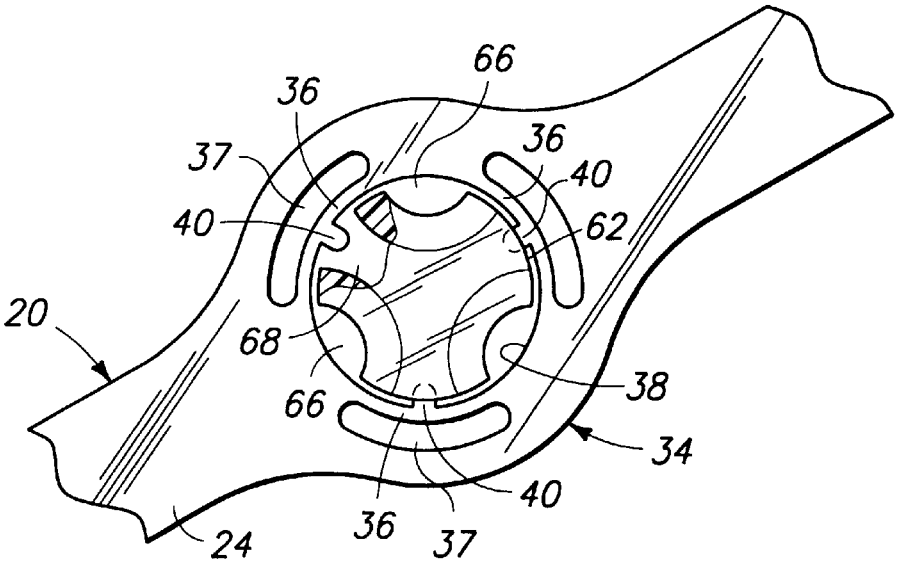
FIG. 9 is a view similar to FIG. 8 only showing the lens rotated and locked in place in the socket member.

To mount a lens 60 to an arm 24, the male fastener member 64 is inserted into a selected socket mount bore 38 with the indentations 66 in alignment with the tabs 40 (FIGS. 6, 7). Once the male fastener members are inserted into the socket bores, the lens may be rotated as shown in FIG. 8 to the position shown in FIG. 9. The indentations will spring the tabs outwardly to the male fastener member diameter. Then, when the openings 68 are rotated into alignment with the tabs, the flexed ribs 36 will spring the tabs into the openings, locking the lens to the arm.

In preferred forms, a number of the lenses 60 (equal to the number of socket mounts 34) are releasably mountable to the socket mounts 34 to form a decorative surface for the fixture 10 as shown in FIG. 16.

Assembly of the preferred fixture as a spherical display may be accomplished as follows.

Firstly, a pair of the frames are positioned upwardly adjacent a band 48, the channels of which being positioned to face the frames. Next, radially opposed pairs of the arms 24 are bent downwardly and the ends 30 are snapped into substantially diametrically opposed openings 50 of the bands. The mounting apertures 34 in the arm ends will snap over the locking tabs 52 within the band openings 50, securing the arms in place. This process is repeated until all the arms are bent into semi-spherical configurations and are fastened to respective bands 48.

Next, a cord 28 may be threaded through the cord apertures 26 (FIG. 1) in the manner shown in FIG. 12. A knot or other abutment at the cord end will prevent the cord from being pulled through the fixture, and the opposite cord end is made available to suspend the fixture from an appropriate structure.

With the halves separated as shown in FIG. 11, a complete strand of conventional Christmas lights may be bunched up and placed into the interior of one or both of the semi-spherical fixture halves. Appropriate portions of the strand wires W may be attached to the hooks 42 to hold the bunch of lights in a desired array within the confines of the formed semi-spherical halves. The "plug-in" end of the strand may be pulled between any selected adjacent arms 24 for connection to a source of electricity.

Now the halves may be joined by moving the bands together so the pin and socket arrangements fit together, preventing the halves from rotating relative to one another. The clasps 56 may now be snapped over the joined bands, to hold the bands and attached frames together.

Finally, the lenses may be attached to the formed frames using the procedure described above. The light fixture is now fully assembled and ready for use and enjoyment. When the light strand or strands are plugged into a source of energy, the multiple lights will emit light through the lenses (and transparent frames), casting a delightful decorative lighting effect outwardly of the fixture.

It is noted that either the lenses 60 or conventional Christmas light sockets may be secured to the mounts 34. It is possible that several lights from a strand could be secured to some or all of the mounts, and that the remaining mounts, if any, may be used to mount lenses. Preferably, however, when the fixture is formed in a spherical configuration, all the mounts will be supplied with lenses and the lights (if provided) will be held inside the spherically formed frames 20.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A decorative light fixture, comprising:

a flat frame including a central hub with arms spaced angularly about the central hub and extending outwardly therefrom;

socket mounts formed integrally with the arms at positions spaced radially from the central hub; and wherein the frame is formed of flexible material enabling the arms to be bent about a center point spaced on an axis from the central hub.

2. A decorative light fixture as defined by claim 1, wherein the frame is formed of substantially transparent material.

3. A decorative light fixture as defined by claim 1, wherein the socket mounts include yieldable socket members shaped to receive and mount conventional Christmas light sockets.

4. A decorative light fixture as defined by claim 1, further comprising light lenses releasably mountable to the socket mounts.

5. A decorative light fixture as defined by claim 1, further comprising:

a wire retention hook mounted to at least one of the arms and projecting therefrom, the hook being configured to receive and secure a Christmas light wire.

6. A decorative light fixture as defined by claim 1, further comprising a cord receiving aperture formed through the central hub.

7. A decorative light fixture, comprising:

a pair of frames, each including a central hub with arms spaced angularly about the central hub and formed in a semi-spherical configuration about a center point;

a band releasably joining the pair of frames with their center points substantially coincidental along an axis such that the arms of both frames form a substantially spherical configuration; and socket mounts on the arms at varying positions spaced substantially radially from the center points.

8. A decorative light fixture as defined by claim 7, wherein each of the frames is formed of flexible material enabling the arms to be bent about the respective center point.

9. A decorative light fixture as defined by claim 7, wherein the frames are formed of substantially transparent material.

10. A decorative light fixture as defined by claim 7, wherein the socket mounts include yieldable socket members shaped to receive and mount conventional Christmas light strand sockets with connecting electrical wires received within at least one of the semi-spherical configuration.

11. A decorative light fixture as defined by claim 7, further comprising light lenses releasably mountable to the socket mounts.

12. A decorative light fixture as defined by claim 7, further comprising light lenses with male fastener members thereon and wherein the socket mounts include yieldable female socket members releasably receiving the male fastener members.

13. A decorative light fixture as defined by claim 7, further comprising:

a wire retention hook mounted to at least one of the arms and projecting therefrom, the hook being configured to receive and secure a Christmas light wire.

14. A decorative light fixture as defined by claim 7, further comprising a cord receiving aperture formed through each of the central hubs.

15. A decorative light fixture as defined by claim 7, wherein the arms extend from the central hubs to ends and wherein the band is comprised of a circular member with an arm end receiving socket configured to releasably receive and secure the ends of said arms.

16. A decorative light fixture as defined by claim 7, wherein the arms extend from the central hubs to ends and wherein the band is comprised of a pair of circular members with axially open arm end receiving sockets configured to releasably receive and secure the ends of said arms; and band clasp members configured to secure the bands together in such a manner that the pair of frames are mounted together in said spherical configuration.

* * * * *